US005541895A

United States Patent [19]

Nussbaum

[11] Patent Number: 5,541,895

[45] Date of Patent: Jul. 30, 1996

[54] WATCH CASE WITH ROTATING BEZEL

[75] Inventor: Augustin Nussbaum, Areuse, Switzerland

[73] Assignee: Montres Rolex S. A., Geneva, Switzerland

[21] Appl. No.: 488,862

[22] Filed: Jun. 9, 1995

[30] Foreign Application Priority Data

Jun. 9, 1994 [CH] Switzerland ..... 01815/94

[51] Int. Cl.[6] ..... G04B 37/00

[52] U.S. Cl. ..... 368/295

[58] Field of Search ..... 368/294–296

[56] References Cited

U.S. PATENT DOCUMENTS

| | | | |
|---|---|---|---|
| 3,271,945 | 9/1966 | Anderson | 368/295 |
| 3,662,537 | 5/1972 | Fujimori | 368/295 |
| 4,815,053 | 3/1989 | Dal Busco | 368/294 |
| 5,122,997 | 6/1992 | Schneider et al. | 368/294 |
| 5,319,617 | 6/1994 | Senoea | 368/294 |

FOREIGN PATENT DOCUMENTS

| | | |
|---|---|---|
| 2307301 | 11/1976 | France . |
| 470018 | 2/1992 | France . |
| 1673621 | 5/1971 | Germany . |
| 47-17028 | 6/1972 | Japan . |
| 340191 | 9/1959 | Switzerland . |

*Primary Examiner*—Vit W. Miska

*Attorney, Agent, or Firm*—Cushman Darby & Cushman, L.L.P.

[57] ABSTRACT

A rotating bezel (18) is hooked on a fixed ring (17) intended to be fixed to the frame of the casing. This bezel (18) comprises a toothed rack (21) in which is engaged the free end (22*b*) of a positioning spring-wire (22) whose other end (22*a*) is elbowed and engaged in a hole (23) of the fixed ring (17). This spring-wire (22) comprises three segments, two end segments (22*c*, 22*d*) practically straight and tangential to a circle concentric with the bezel (18) and an intermediate curved segment (22*e*) with its center of curvature inside the bezel (18) but of radius substantially smaller than that of the bezel. The shape of the spring (22) permits the forces necessary to rotate the bezel (18) in the two directions to be made practically equal.

5 Claims, 3 Drawing Sheets

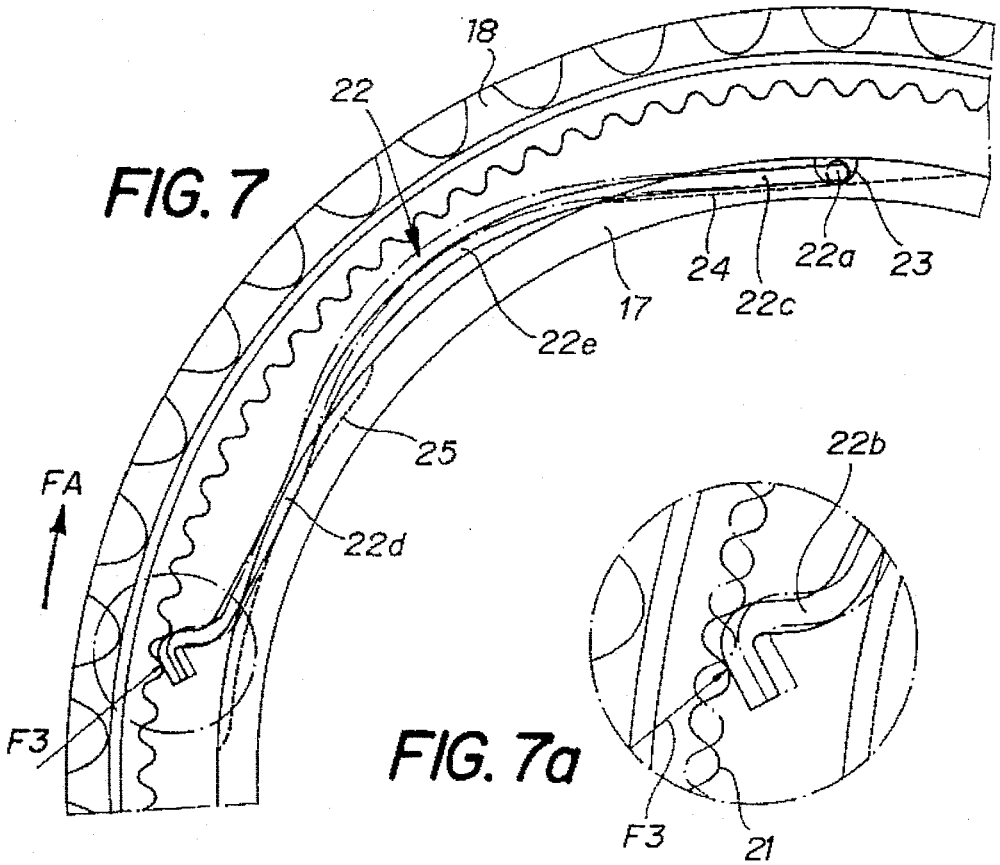
FIG. 7
FIG. 7a
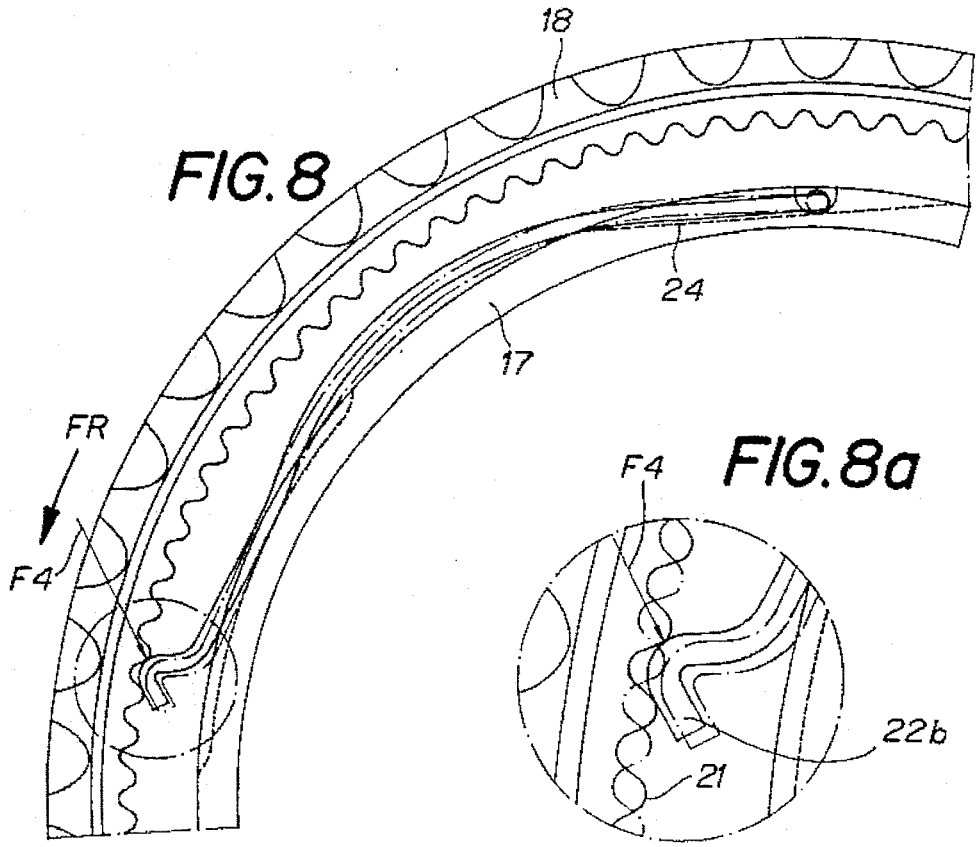
FIG. 8
FIG. 8a

WATCH CASE WITH ROTATING BEZEL

BACKGROUND OF THE INVENTION

1. Field of the Invention

The present invention relates to a watch casing with a rotating bezel comprising an angular positioning device for the bezel, having a toothed rack and a spring-wire whose free end is resiliently and radially engaged in engagement with the toothed rack. The two parts in engagement, the spring and the toothed rack, are arranged to permit the displacement in angular steps of the bezel in both directions of rotation of the latter, the toothed rack and other end of the spring-wire being, the one integral with the rotating bezel, and the other with the casing.

2. Description of the Prior Art

In CH 536,509 there has already been proposed an angular positioning device for a rotating bezel, which requires equal forces to rotate the bezel in the two directions. To this end, an edgewise toothed rack is formed in a lower face of the rotating bezel, the teeth having a profile in the form of an equilateral or isosceles triangle. A piston is mounted in a cylindrical recess having a longitudinal axis parallel to the axis of rotation of the rotating bezel and formed in an upper face of the casing wall, immediately below the rotating bezel. This piston is pressed axially against the toothed rack of the rotating bezel by a spiral spring disposed between one end of the piston and the base of the cylindrical recess. The other end of the piston has a profile substantially matching the space between the two teeth. The angle formed by each face of the teeth relative to the longitudinal axis of the piston being the same, the force necessary to rotate the bezel is equal in the two directions of rotation.

The disadvantage of this solution lies in the large axial dimension occupied by the piston and spring device. If such a device can strictly speaking be fitted within the frame to work with an edgewise toothed rack to exert on it pressure parallel to the axis of rotation of the bezel, it is not usable due to lack of space with a toothed rack formed on a lateral face of the bezel on which the positioning device must apply a radial force. In effect, in this case the available space between the rotating bezel and the watch crystal which is located in the same plane in no case permits the piston positioning device to be accommodated, which must therefore work radially and no longer axially relative to the center of rotation of the rotating bezel.

EP-A-0 470 018 relates to a mechanism in which a spring in the form of an open ring has one end integral with a rotating leading element and another end resiliently engaged in a notch of a led rotating element, coaxial with the leading element. Above a given couple value, the leading and led rotating elements separate by sliding of the spring. Contrary to what is sought to be obtained by the present invention, one obtains by this mechanism a different sliding couple value according to the direction of rotation, as is specified in this document.

DE-A16 73 621 relates to a positioning mechanism for a toothed wheel comprising a spring fixed to a pin at one end and bearing on a second pin at the other end. The median portion of this spring situated at the apex of an obtuse angle between the two straight arms has a projecting portion in the form of an arc of a circle, which engages the teeth of the wheel. It is not a question, in this case, of a spring whose free end is in engagement with a toothed rack. It is in effect the median portion of the spring which serves to position the toothed rack. Given that one end of the spring is fixed while the other end can slide on the pin against which it abuts, the force necessary to overcome the pressure of the spring is not the same in the two directions of rotation of the wheel. In effect, in one direction the toothed rack exerts a force on the spring of which one component makes the free end of the spring slide against the pin, while in the opposite direction this same component is substantially parallel to the straight arm of the spring whose end is fixed to the other pin. As this end of the spring is fixed and the component of force is parallel to the straight arm of the spring, this component is neutralized and only the other component of force can bend the spring. This explains why this system does not permit one to work with the same force in the two directions of rotation of the positioning wheel and does not therefore offer a solution to the problem that one proposes to solve.

An object of the present invention is to overcome, at least in part,these disadvantages.

SUMMARY OF THE INVENTION

The advantage of the solution proposed resides in the fact that it involves as the only modification a change in the shape of the spring, and preferably, the formation of a second milled portion in the fixed ring integral with the frame.

BRIEF DESCRIPTION OF THE DRAWINGS

The invention will now be described in more detail, by way of example only, with reference to the accompanying drawings, in which:

FIGS. 7 and 8 are views similar to FIG. 4 showing the behavior of the positioning spring of the rotating bezel in each direction of rotation.

FIGS. 7*a* and 8*a* are partial enlarged views of FIGS. 7 and 8 respectively.

DESCRIPTION OF THE PREFERRED EMBODIMENTS

Figure 1:
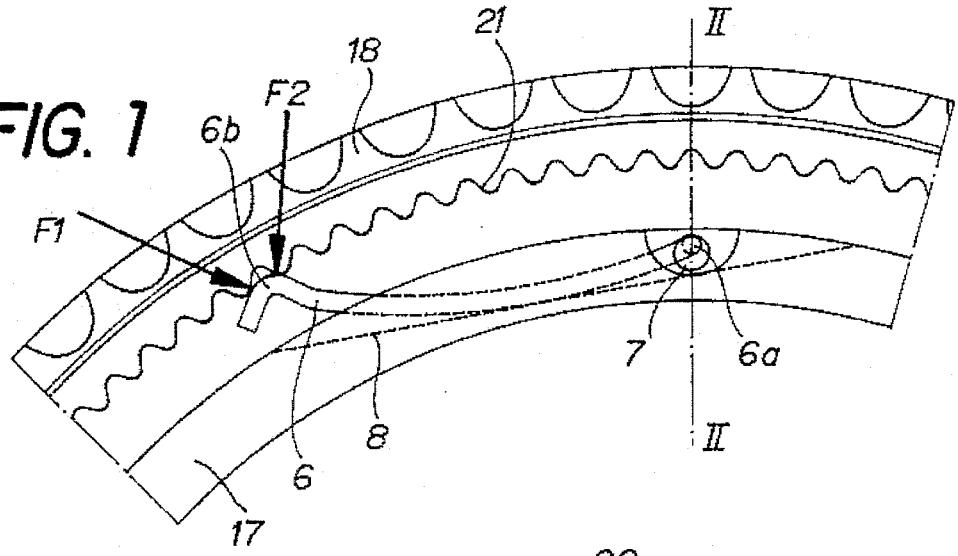
FIG. 1 is a partial view in plan of a prior art watch casing with a rotating bezel.
Figure 2:
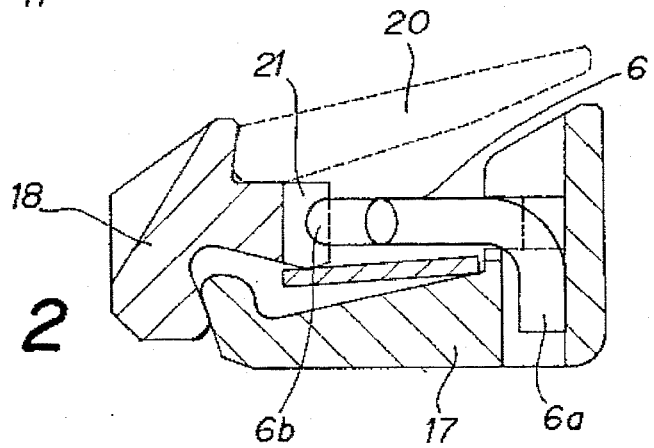
FIG. 2 is a sectional view along the line II—II of FIG. 1.

FIGS. 1 and 2 show only a fixed ring 17 (intended to be mounted on a casing frame 10, FIG. 3) and the rotating bezel 18 in the ring 20 drawn in dashed lines in FIG. 2, which permits one to see, in FIG. 1, the positioning mechanism which comprises a toothed rack 21 formed in the internal lateral face of the rotating bezel 18 and a positioning spring-wire 6 whose end 6*a* is elbowed and enters a hole 7 of the fixed ring 17, and whose other end, elbowed in the shape of a V, 6*b*, enters the toothed rack 21. The spring-wire 6 is slightly curved with its center of curvature located outside the rotating bezel 18, the convex part of the spring-wire 6 bearing against the base of a milled portion 8 formed on a lateral external face of the fixed ring 17. The spring-wire 6 is thus loaded and tends to maintain the free end 6*b* in engagement with the toothed rack.

When a bezel 18 is rotated in the clockwise direction, a force F1, which forms a very acute angle with the spring-wire 6, is applied against the end 6b of the spring-wire 6 so that the component tending to bend the spring-wire is small. On the contrary, if the bezel 18 is rotated anti-clockwise, the applied force $F_2$ is directed substantially perpendicularly to the spring-wire 6.

The result is that the force necessary to rotate the bezel 18 varies substantially according to the direction of rotation.

Figure 3:
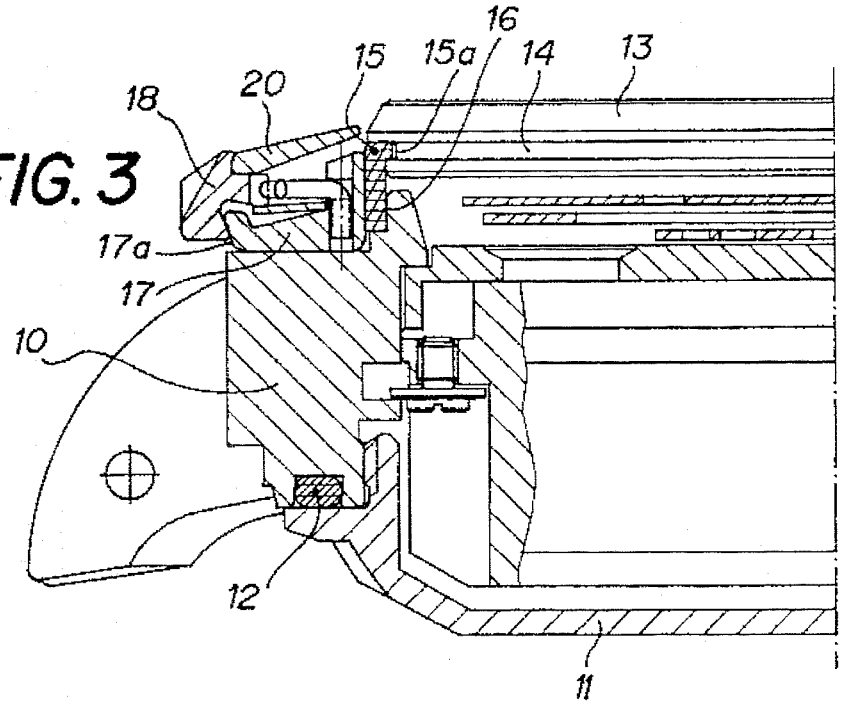
FIG. 3 is a sectional view of the casing with the watch movement.

The watch casing with the rotating bezel shown in FIG. 3 comprises a frame 10, a base 11 screwed into the frame, a watertight seal 12 between the base 11 and the frame 10, and a crystal 13 having a peripheral groove 14 in which a lateral projection 15a of an annular watertight seal 15 is engaged. This seal is compressed between a cylindrical surface of the frame 10 and a ring 17 mounted around the annular water tight seal 15. This ring 17 comprises a peripheral conical face 17a on which is hooked a rotating bezel 18 comprising a conical face 18a corresponding to the face 17a. A flat elastic ring 19 bears through the part of its lower face adjacent its internal edge against the fixed ring 17, and through the part of its upper face adjacent its external edge against the rotating bezel 18 and serves to apply resiliently one against the other the conical faces 17a of the ring 17 and 18a of the rotating bezel 18. It will be observed that the rotating bezel 18 can be displaced axially against the frame 10 against the force of the flat elastic ring 19, thus permitting the conical faces 17a and 18a to be separated one from the other and the bezel 18 to be turned.

This rotating bezel further comprises an upper bearing 18b on which is forcibly fitted a ring 20 carrying, for example, clock gradations. The part of the rotating bezel 18 adjacent the bearing receiving the ring 20 extends toward the interior. A toothed rack 21 is cut out in this part of the rotating bezel 18.

Figure 4:
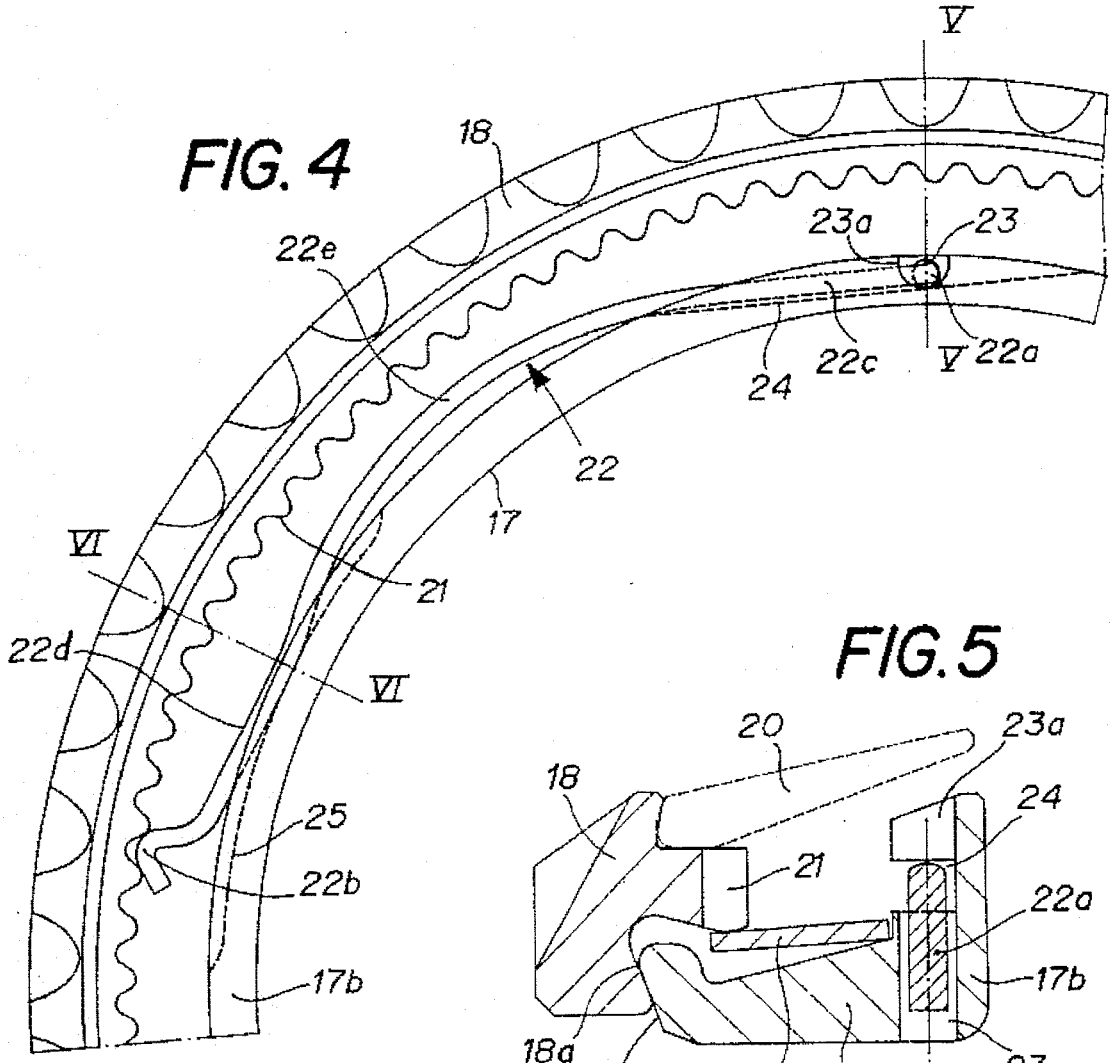
FIG. 4 is a partial view from above without the graduated ring of only the rotating bezel mechanism of the casing of FIG. 3 in accordance with the invention.
Figure 5:
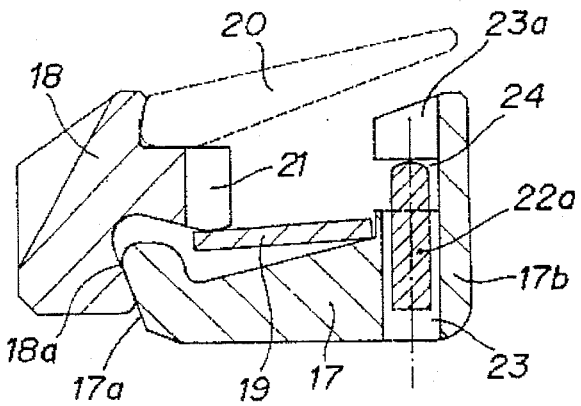
FIGS. 5 and 6 are sectional views respectively along lines V—V and VI—VI of FIG. 4.
Figure 6:
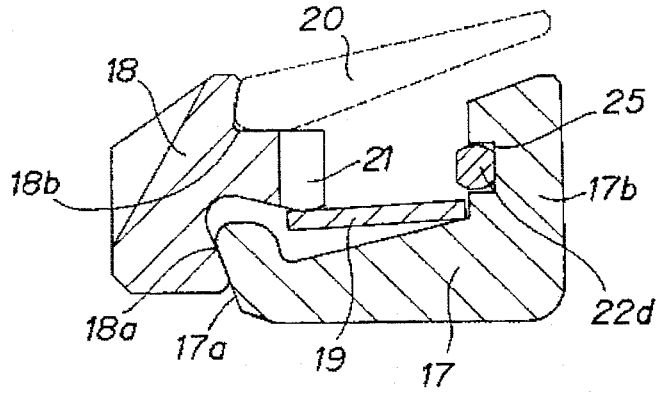

As shown in FIGS. 4 to 6, apart from this toothed rack 21, the positioning device with the rotating bezel 18 comprises a spring-wire 22 whose elbowed end 22a (FIG. 5) is engaged in an anchoring opening 23 of the fixed ring 17, and whose other end is doubly elbowed in the form of a V 22b to engage the toothed rack 21. This spring-wire 22, which extends over about one-quarter of the circumference of the bezel, has three distinct segments, two practically straight segments 22c, 22d adjacent respectively the ends 22a, 22b. These practically straight segments 22c, 22d are connected one each other by a segment 22e in the shape of an arc of a circle. The center of this arc of a circle is inside the ring 17, but its radius is smaller than that of the rotating bezel 18. In this example, the radius of curvature of the segment 22e corresponds to half of the mean radius of the rotating bezel 18. The two practically straight segments 22c and 22d are substantially tangential to a circle centered on the central axis of the casing. The material used to make the spring-wire 22 is a steel alloy sold under the mark Nivaflex® and submitted to a conventional heat treatment for four hours at 400° C.

Two millings are formed in the annular internal part 17b of the fixed ring 17, which is also the part of this ring whose height is the greatest. The milling 24 is practically tangential to a circle centered on the central axis of the ring 17 and passes through the edge of the hole 23 closest to this central axis. This milling 24 is also practically parallel to the segment 22c and the spring 22. A cut-out 23a formed opposite hole 23 permits the introduction of the end 22a of the spring-wire 22 into this hole 23. The other milling 25 forms an arc of a circle centered on the central axis of the ring 17. It serves as a support for a part of the side of the segment 22d of the spring-wire 22 opposite the toothed rack 21, and now thus the elbowed end 22b constantly resiliently in engagement with the toothed rack 21.

Let us now examine the behavior of the spring 22 in each direction of rotation of the rotating bezel 18. FIG. 7 shows in full line the spring-wire 22 in the rest position with its doubly elbowed end 22b engaged between two teeth of the toothed rack 21. In FIG. 7a, there is shown in mixed lines, the toothed rack 21 between the two stable angular positions when the rotating bezel is driven in the clockwise direction (arrow $F_A$). The force $F_3$ which is exerted on the end 22b of the spring-wire forms a very small acute angle with the segment 22d of the spring-wire 22 so that the essential part of this force is transmitted by the segment 22d to the segment 22e in the arc of a circle, making it bend towards the outside. At the same time, the segment 22d swings slightly about its support against the milling 25 in the opposite sense to the clockwise direction, allowing the passage of the tooth, after which the V-shaped elbowed end 22b enters anew into the following intertooth space.

Contrary to what happens with the positioning spring of the state of the art (FIGS. 1 and 2) where the force $F_1$ must bend a spring-wire forming a very slight acute angle with the direction of the applied force, in the case of the present invention, this same force which is exerted almost on the axis of the segment 22d serves to bend the curved segment 22e. The force applied to this curved segment 22e by the segment 22d is substantially tangential to this curved segment 22e. Furthermore, the latter is connected to the anchor point formed by the opening 23, by the segment 22c, tangential to the other end of the segment 22e and which is freely mounted in this opening, so that the latter compresses the curved segment 22e by applying to it two tangential forces in opposite directions to its respective ends. The force to be exerted on the bezel 18 is thus substantially less than that which must be exerted on the rotating bezel 3 of the FIGS. 1 and 2 of the state of the art.

FIG. 8 shows the behavior of the spring-wire 22 when the rotating bezel is driven in the anti-clockwise direction (arrow $F_R$). As the spring 22 drawn in mixed lines and illustrating the intermediate position shows, the force $F_4$ exerted on the end 22b pulls this end in the direction of rotation $F_R$ and initiates on the curved segment 22e a tangential pull which leads the curvature of this segment toward the center and causes a swinging of the segment 22a about its support point against the milling 25 in the clockwise direction, thus increasing the force exerted on the bezel 18 to make it turn.

It will thus be realized that the spring-wire 22 allows a reduction in the force necessary to drive the rotating bezel 18 in the clockwise direction ($F_A$) and an increase this force when this rotating bezel 18 is driven in the opposite direction ($F_R$). It is also possible, due to the shape of the spring-wire 22, to finely balance the force necessary to turn the bezel in both senses of rotation by acting as necessary on its curvature.

I claim:

1. A watch casing with a rotating bezel and an angular positioning device for the bezel, comprising a toothed rack means, a spring-wire means whose free end is resiliently and radially in engagement with said toothed rack means to permit the displacement in angular steps of the bezel in both directions of rotation of the latter, one of said toothed rack means and said spring-wire means being integral with the rotating bezel and the other being integral with said casing, said spring-wire means comprising two end segments that are substantially straight and tangential to an arc of a circle concentric with the axis of rotation of the rotating bezel and an intermediate curved segment connecting said end segments to each other, said curved segment having a center of curvature located inside said bezel and a radius of curvature substantially less than the distance separating said curved segment with the axis of rotation of said rotating bezel, and said spring-wire means having a free end resiliently maintained in engagement with said toothed rack means by a support surface formed in said means integral with said other end of said spring-wire means and against which is applied a side opposite to said toothed rack means of a part of said end segment adjacent said free end of said spring-wire means.

2. A watch casing as claimed in claim 1, wherein said means integral with said other end of said spring-wire means includes at least one positioning groove located in a same parallel plane and at the same height as the plane of the toothed rack and adapted to receive respectively at least a portion of said end segments, the base of the positioning groove receiving the segment adjacent the free end, constituting the said support surface.

3. A watch casing a claimed in claim 2, wherein said means integral with said other end of said spring-wire means is said casing.

4. A watch casing as claimed in claim 3, wherein said at least one positioning groove is formed in a ring forming part of said casing.

5. A watch casing as claimed in claim 4, wherein two said positioning grooves are formed in said ring bearing against said respective end segments of said spring-wire means, said curved segment curving convexly toward said toothed ring means between said end segments.

* * * * *